United States Patent [19]

Takemasa et al.

[11] Patent Number: 4,788,829

[45] Date of Patent: Dec. 6, 1988

[54] LOW-TEMPERATURE REFRIGERATION SYSTEM

[75] Inventors: Kazuo Takemasa, Ota; Fukuji Yoshida, Nitta; Kenji Iwasa, Chiyoda, all of Japan

[73] Assignee: Sanyo Electric Co., Ltd., Japan

[21] Appl. No.: 910,881

[22] Filed: Sep. 24, 1986

[30] Foreign Application Priority Data

Sep. 25, 1985 [JP] Japan ..... 60-211872
Apr. 21, 1986 [JP] Japan ..... 61-91598

[51] Int. Cl.[4] ..... F25B 7/00

[52] U.S. Cl. ..... 62/335; 62/113; 62/114; 62/175; 62/502; 62/512; 62/513

[58] Field of Search ..... 62/335, 113, 114, 175, 62/502, 512, 513; 252/67, 70, 71

[56] References Cited

U.S. PATENT DOCUMENTS 3,642,639 3/1972 Murphy et al. ..... 252/67
3,733,845 5/1973 Lieberman ..... 62/335
4,149,389 4/1979 Hayes et al. ..... 62/114 X
4,539,028 9/1985 Paradowski et al. ..... 62/335 X
4,540,501 9/1985 Ternes et al. ..... 62/114 X
4,545,795 10/1986 Liu et al. ..... 62/335 X
4,586,344 5/1986 Lutz et al. ..... 62/335 X
4,597,268 7/1986 Andersson ..... 62/335 X
4,679,403 7/1987 Yoshida et al. ..... 62/114

FOREIGN PATENT DOCUMENTS 21658 2/1979 Japan ..... 62/335

*Primary Examiner*—Steven E. Warner
*Attorney, Agent, or Firm*—Darby & Darby

[57] ABSTRACT

A refrigeration system includes first and second refrigerant circuits each having a compressor, a condenser and an evaporator, each of the refrigerant circuits being charged with an organic refrigerant. The evaporator of the first refrigerant circuit is divided into a plurality of evaporator portions connected together in series. The condenser of the second refrigerant circuit is divided into condenser portions equal in number to the number of the evaporator portions of the first refrigerant circuit. The condenser portions of the second refrigerant circuit are paired with the evaporator portions of the first refrigerant circuit to provide heat exchangers. The refrigerant of the second refrigerant circuit is a mixture of refrigerants different in kind and in boiling point.

11 Claims, 10 Drawing Sheets

LOW-TEMPERATURE REFRIGERATION SYSTEM

FIELD OF THE INVENTION

The present invention relates to a refrigeration system incorporating compressors, and more particularly to a refrigeration system for achieving cryogenic temperatures.

RELATED ART STATEMENT

Refrigeration systems for refrigerators conventionally used in physicochemical laboratories or the like, for example, for preserving living body cells achieve low temperatures which are limited to about −80° C. Cells can be preserved in a frozen state at such low temperatures, but with the lapse of time, the nuclei of ice crystals within the frozen cell recombine to produce larger ice crystals, rupturing the cell. This phenomenon is called recrystallization of ice. It is known that the recrystallization of ice does not occur in an environment lower than −130° C. which is the recrystallization point of ice. Thus, cells are preservable almost permanently at cryogenic temperatures lower than −130° C., so that it has been expected to provide refrigeration systems for achieving such cryogenic temperatures.

With refrigeration systems of this type, especially those incorporating a compressor, a hot gaseous refrigerant discharged from the compressor is introduced into a condenser, liquefied therein by heat exchange with air or water, then passed through a pressure reducer for pressure adjustment and thereafter admitted into an evaporator for evaporation. When evaporating, the refrigerant absorbs heat of vaporization from the environment to produce a cooling effect. The lowest temperature to be achieved by refrigeration systems employing a single refrigerant and incorporating a usual compressor is limited to about −40° C.

Refrigeration systems are also known which comprise two independent closed refrigerant circuits which are cascade-connected (that is, the evaporator of one circuit and the condenser of the other circuit are combined for heat exchange to serve as a cascade condenser). A refrigerant having a low boiling point is enclosed in one of the circuits to cause the circuit to achieve low temperatures. However, the temperature to be achieved is limited to about −80° C. when usual compressors are used.

U.S. Pat. No. 3,768,273 issued on Oct. 3, 1973 discloses a refrigeration system which employs a mixture of different refrigerants having varying boiling points and in which the refrigerants of higher boiling points are evaporated to condense the refrigerants of lower boiling points successively, such that the refrigerant of the lowest boiling point is evaporated at the final stage to achieve a low temperature using a single compressor. The temperature eventually achievable by this system is also limited to about −80° C. if the compressor used is of the usual type since the pressure and temperature are limited.

To overcome the drawbacks of the foregoing systems, U.S. Pat. No. 3,733,845 issued on May 22, 1973 discloses another system which comprises two independent closed refrigerant circuits in cascade connection and in which a refrigerant mixture is used for the circuit of low temperature in the same manner as above to achieve cryogenic temperatures.

The system disclosed in U.S. Pat. No. 3,733,845 can be adapted to achieve temperatures lower than −130° C. with use of a usual compressor (e.g. of about 1.5 hp). However, to achieve temperatures lower than 130° C., the cascade condenser needs to effect full heat exchange and must therefore be large-sized to assure a sufficient area of heat exchange. On the other hand, the low-temperature refrigerant circuit charged with the refrigerant mixture is adapted to successively condense the refrigerants of lower boiling points by evaporating those of higher boiling points, so that the circuit makes the system itself invariably larger. This and the use of large cascade condenser render the system still larger.

SUMMARY OF THE INVENTION

This invention provides a refrigeration system comprising first and second two refrigerant circuits each having a compressor, a condenser and an evaporator, the outlet of the compressor being connected to the inlet of the condenser by a line, the outlet of the condenser being connected to the inlet of the evaporator by another line, the outlet of the evaporator being connected to the inlet of the compressor by another line, each of the refrigerant circuits being charged with an organic refrigerant; the evaporator of the first refrigerant circuit being divided into a plurality of evaporator portions connected together in series with respect to the flow of the refrigerant; the condenser of the second refrigerant circuit being divided into condenser portions equal in number to the number of the evaporator portions of the first refrigerant circuit, the condenser portions being connected together in parallel with respect to the flow of the refrigerant; the condenser portions of the second refrigerant circuit being paired with the evaporator portions of the first refrigerant circuit to provide heat exchangers, the refrigerant of the second refrigerant circuit being a mixture of refrigerants different in kind and in boiling point, whereby the evaporator of the second refrigerant circuit is cooled to a cryogenic temperature.

As mentioned above, the evaporator of the first refrigerant circuit is divided into portions, and the condenser of the second refrigerant circuit is divided into portions which are equal in number to the evaporator portions. The divided evaporator portions are connected together in series, while the divided condenser portions are connected together in parallel. The evaporator portions and the condenser portions are paired to provide heat exchangers, i.e., cascade condensers. Thus, compacted cascade condensers are available without entailing a reduced heat exchange efficiency, making the system installable with greater freedom and rendering the entire system smaller.

According to the invention, the evaporator portions of the first circuit and the condenser portions of the second circuit constitute preferably two to four, more preferably, two heat exchangers, i.e., cascade condensers. To reduce the entire size of the refrigeration system, the cascade condensers are divided so as to be accommodated, for example, within the thickness of a heat insulator. It is of course desirable that the cascade condensers be so divided as to be identical in refrigerant flow rate and size to assure the balance therebetween readily.

Preferably, the system of the invention has the following construction. The line connecting the outlet of the evaporator of the second refrigerant circuit to the inlet of its compressor has a plurality of intermediate heat exchangers connected together in series. The line connecting the outlet of the condenser of the second refrigerant circuit to the inlet of the evaporator thereof has a plurality of pressure reducers and vapor-liquid separators smaller in number to the number of the pressure reducers and comprises a first line portion for introducing the refrigerant flowing through the condenser of the second refrigerant circuit into one of the vapor-liquid separators and admitting the condensed portion of the refrigerant into one of the intermediate heat exchangers through one of the pressure reducers, a number of line portions for bringing the uncondensed portion of the refrigerant from said one vapor liquid separator into heat exchange with said one intermediate heat exchanger, subsequently introducing the second mentioned portion of the refrigerant into another one of the vapor-liquid separators and admitting the resulting condensed portion of the refrigerant into another one of the intermediate heat exchangers through another one of the pressure reducers, and a line portion in the final stage for admitting the portion of the refrigerant having the lowest boiling point and passing through the line portions into the evaporator of the second refrigerant circuit through the pressure reducer in the final stage.

Further preferably according to the present invention, the temperature difference between the refrigerant flowing into the pressure reducer in the final stage and the refrigerant flowing out of the pressure reducer in the final stage is smaller than the value obtained by dividing the temperature difference between the condenser of the second refrigerant circuit and the evaporator thereof by the number of the pressure reducers and larger than 10° C. This obviates variations in the evaporator temperature and insufficient cooling, permitting the refrigeration system to exhibit stabilized cooling performance and giving the system higher reliability and prolonged life.

BRIEF DESCRIPTION OF THE DRAWINGS

FIG. 1 is a diagram showing the refrigerant circuit of the refrigeration system;

FIG. 2 is a diagram showing an electric circuit for controlling the same;

FIG. 3 is a timing chart for illustrating the operation of the refrigeration system;

FIG. 4 is a perspective view showing a refrigerator incorporating the refrigeration system;

FIG. 5 is a side elevation in section showing the main body of the refrigerator;

FIG. 6 is a diagram specifically showing the construction of the refrigerant circuit of the refrigeration system;

FIG. 7 is a perspective view showing an intermediate heat exchanger unit;

FIG. 8 is a perspective view showing the rear side of the refrigerator;

FIG. 9 is a diagram showing variations in the internal temperature of the storage chamber with time after the power supply is turn on;

FIG. 11 is a perspective view showing a Bourdon tube constituting the self-recording temperature recorder; and FIG. 12 is a diagram showing the relation between the internal pressure of the Bourdon tube having 2-methylpentane enclosed therein and the temperature of a temperature sensor portion.

DESCRIPTION OF THE PREFERRED EMBODIMENT

An embodiment of the present invention will be described below with reference to the accompanying drawings.

Figure 1:
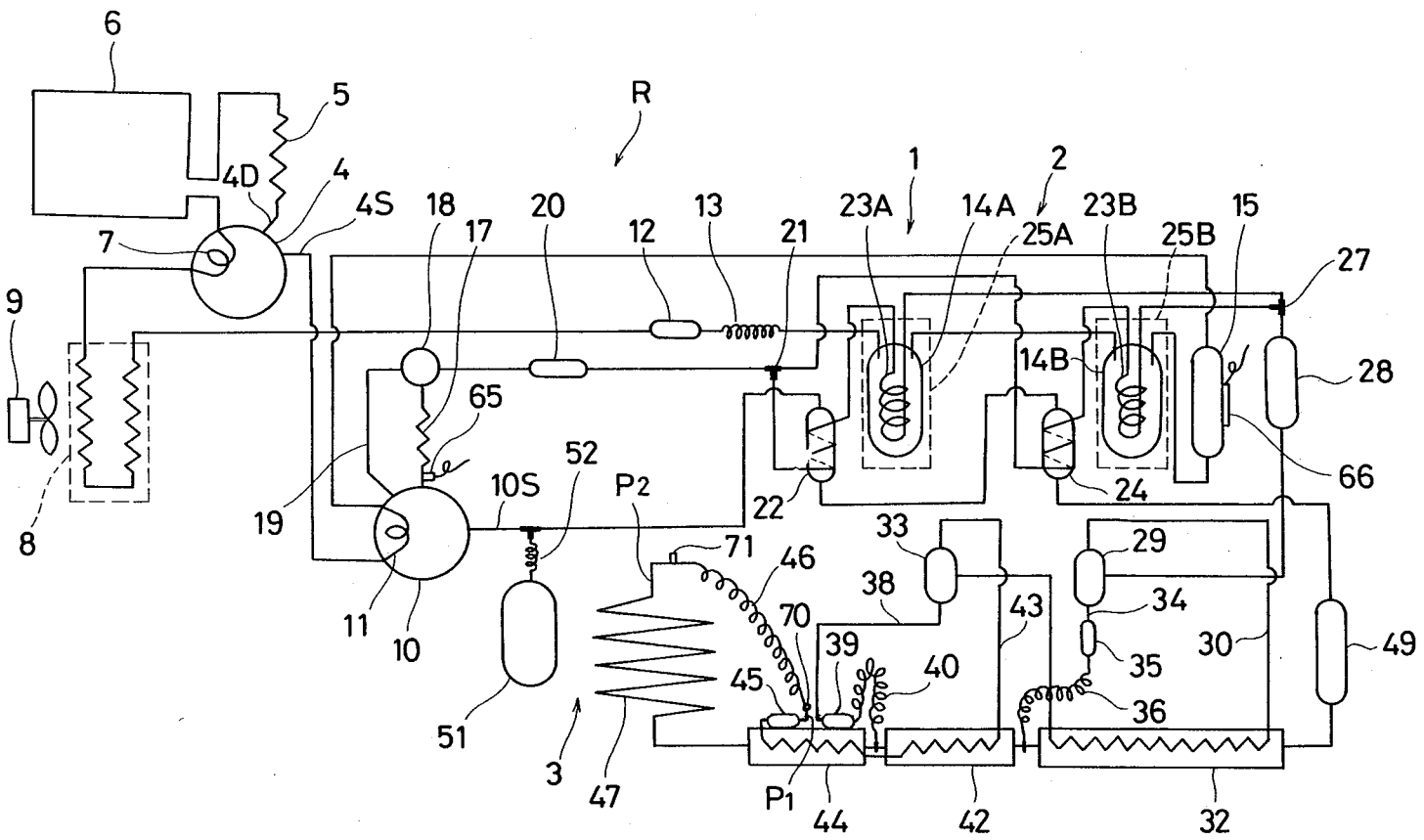
FIGS. 1 to 9 show a refrigeration system embodying the present invention.

FIG. 1 shows the refrigerant circuit 1 of a refrigeration system R. The refrigerant circuit 1 comprises a high-temperature refrigerant circuit 2 serving as a first (closed) refrigerant circuit and a low-temperature refrigerant circuit 3 as a second (closed) refrigerant circuit, the circuits 2 and 3 being independent of each other. Indicated at 4 is an electric compressor included in the high-temperature refrigerant circuit 2 and operable by a single-phase or three-phase a.c. power supply. The compressor 4 has an outlet pipe 4D connected to an auxiliary condenser 5, which is further connected to a pipe 6 for heating the storage chamber opening edge of a refrigerator 75 to be described later in detail to prevent condensation of moisture on the edge. The pipe 6 is connected to an oil cooler 7 of the compressor 4 and further to a condenser 8. Indicated at 9 is a fan for cooling the condenser 8. A refrigerant pipe extends from the condenser 8 to a dryer 12, then to a pressure reducer 13 and further to a first evaporator 14A and a second evaporator 14B provided as components of an evaporation unit, from which the refrigerant pipe is connected to an accumulator 15 and further to an inlet pipe 4S for the compressor 4 via an oil cooler 11 for an electric compressor 10 included in the low-temperature refrigerant circuit 3. The first and second evaporators 14A and 14B are connected together in series to constitute the evaporation unit of the high-temperature refrigerant circuit 2.

The high-temperature refrigerant circuit 2 is charged with refrigerant R-502 (a mixture of 48.8 wt. % of R-12 ($CCl_2F_2$, dichlorodifluoromethane) and 51.2 wt. % of R-115 ($C_2ClF_5$, chloropentafluoroethane)) and R-12 which are different in boiling point. The refrigerant ratio is for example 88.0 wt. % of R-502 and 12.0 wt. % of R-12. The refrigerant mixture discharged from the compressor 4 in the form of a hot gas is liquefied in the auxiliary condenser 5, pipe 6, oil cooler 7 and condenser 8 upon condensation and release of heat, then deprived of water in the dryer 12, subjected to a pressure reduction in the pressure reducer 13 and flows into the first and second evaporators 14A and 14B, in which refrigerant R-502 evaporates, absorbing the heat of vaporization from the environment to cool the evaporators 14A and 14B. Via the accumulator 15 serving as a refrigerant reservoir, the refrigerant mixture flows through the oil cooler 11 of the compressor 10 of the low-temperature refrigerant circuit 3 and returns to the compressor 4.

The electric compressor 4 has a capacity, for example, of 1.5 hp, and the evaporators 14A and 14B are eventually cooled to −50° C. during operation. At such a low temperature, R-12 in the refrigerant mixture remains liquid in the vaporators 14A and 14B without evaporation, making little or no contribution to cooling, whereas the lubricant of the compressor 4 and the water remaining unremoved by the dryer 12 are returned as dissolved in the refrigerant R-12 to the compressor 4.

More specifically, the refrigerant R-12 flows out from the accumulator 15 via an oil return port usually formed at the lower end of the pipe extending from the accumulator 15 (the pipe is inserted in the accumulator 15 from above, bent at the lower end and has an open end above the refrigerant liquid level) and is led into the oil cooler 11 of the low temperature refrigerant circuit 3 in the form of a liquid containing the above-mentioned lubricant, etc. Since the compressor 10 has an elevated temperature, R-12 led in evaporates to prevent seizure of the compressor 10 and degradation of the lubricant. Thus, R-12 has the function of returning the lubricant in the high-temperature circuit 2 to the compressor 4 and the function of cooling the compressor 10 of the low-temperature refrigerant circuit 3.

The compressor 10 constituting the low-temperature refrigerant circuit 3 has an outlet pipe 10D (see FIG. 6) which is connected to an auxiliary condenser 17 and then to an oil separator 18, from which extend an oil return pipe 19 connected to the compressor 10 and a pipe connected to a dryer 20. The dryer 20 is connected to a three-way junction 21. One pipe extending from the junction 21 is wound around a second aspiration-side heat exchanger 22 of the low-temperature refrigerant circuit 3 in heat exchange relation therewith and then connected to a first condensation pipe 23A serving as a high-pressure pipe inserted in the first evaporator 14A. The other pipe extending from the junction 21 is similarly wound around a first aspiration-side heat exchanger 24 of the low-temperature refrigerant circuit 3 in heat exchange relation therewith and then connected to a second condensation pipe 23B serving as a high-pressure pipe inserted in the second evaporator 14B. The first evaporator 14A and the first condensation pipe 23A, and the second evaporator 14B and the second condensation pipe 23B constitute cascade condensers 25A and 25B, respectively. The first and second condensation pipes 23A and 23B are joined together at a three-way junction 27, which is connected to a first vapor-liquid separator 29 via a dryer 28. A vapor-phase pipe 30 extending from the vapor-liquid separator 29 extends through a first intermediate heat exchanger 32 and is connected to a second vapor-liquid separator 33. A liquid-phase pipe 34 extending from the separator 29 is connected to a dryer 35, then to a pressure reducer 36 and thereafter to the connection between the first intermediate heat exchanger 32 and a second intermediate heat exchanger 42. A liquid-phase pipe 38 extending from the separator 33 is connected to a dryer 39 (which is disposed preferably in heat exchange relation with a third intermediate heat exchanger 44 as seen in FIG. 1), then to a pressure reducer 40 and subsequently to the connection between the second and third intermediate heat exchangers 42 and 44. A vapor-phase pipe 43 from the separator 33 extends through the second intermediate heat exchanger 42 and then through the third intermediate heat exchanger 44 and is connected to a dryer 45 (which is similarly disposed in heat exchange relation with the third intermediate heat exchanger 44 as shown in FIG. 1) and then to a pressure reducer 46. The pressure reducer 46 is connected to an evaporation pipe 47 serving as an evaporator and connected to the third intermediate heat exchanger 44. The third to first intermediate heat exchangers 44, 42 and 32 are connected together in series. The first exchanger 32 is connected to an accumulator 49, which is connected via the first and second aspiration-side heat exchangers 24 and 22 to an inlet pipe 10S of the compressor 10. The inlet pipe 10S is connected via a pressure reducer 52 to an expansion tank 51 for storing the refrigerant mixture while the compressor 10 is out of operation.

The low-temperature refrigerant circuit 3 has enclosed therein a mixture of four refrigerants which are different in boiling point, i.e., R-12 ($CCl_2F_2$, dichlorodifluoromethane), R-13B1 ($CBrF_3$, bromotrifluoromethane), R-14 ($CF_4$, tetrafluoromethane) and R-50 ($CH_4$, methane) which are premixed together. The refrigerant mixture comprises, for example, 4.0 wt. % of R-50, 22.0 wt. % of R-14, 39.0 wt. % of R-13B1 and 35.0 wt. % of R-12. Although R-50, which is methane, is prone to explosion when combined with oxygen, the hazard of explosion is obviated by mixing R-50 with Freon refrigerants in the above proportions. Accordingly, no explosion occurs even if the refrigerant mixture leaks accidentally.

The refrigerant mixture circulates through the system in the following manner. The refrigerant mixture discharged from the compressor 10 in the form of a gas having a high temperature and high pressure is precooled by the auxiliary condenser 17 and fed to the oil separator 18, in which a major portion of the lubricant of the compressor 10 contained in the mixture is separated off. The separated lubricant is returned to the compressor 10 via the oil return pipe 19, while the refrigerant mixture flows through the dryer 20 and is thereafter divided into two portions at the three-way junction 21. The two refrigerant portions are individually precooled by the aspiration-side heat exchanger 22 or 24 and then cooled by the first or second evaporator 14A or 14B of the cascade condenser 25A or 25B, whereby the high-boiling refrigerant or refrigerants in the mixture are liquefied on condensation. The two refrigerant portions join together at the three-way junction 27. In this way, the refrigerant mixture is divided into two portions of reduced quantities and dividedly cooled by the cascade condenser 25A or 25B. This effects full heat exchange to assure satisfactory condensation.

The refrigerant mixture flowing out from the three-way junction 27 passes through the dryer 28 and enters the vapor-liquid separator 29. At this time, R-14 and R-50 included in the mixture and having a very low boiling point remain in the form of a gas without condensation, while R-12 and R-13B1 only are in the form of a liquid condensate. Accordingly, R-14 and R-50 flow into the vapor-phase pipe 30, as separated from R-12 and R-13B1 flowing into the liquid-phase pipe 34. The refrigerant mixture flowing into the vapor-phase pipe 30 is subjected to heat exchange for condensation at the first intermediate heat exchanger 32 and then flows into the vapor-liquid separator 33. The heat exchanger 32 has a temperature of about −80° C. because the refrigerant of low temperature returning from the evaporation pipe 47 flows into the exchanger 32 and further because R-13B1 flowing into the liquid-phase pipe 34 enters and evaporates in the exchanger 32 after passing through the dryer 35 and the pressure reducer 36, these refrigerants thus contributing to cooling. Consequently, a major portion of R-14 in the refrigerant mixture passing through the vapor-phase pipe 30 is liquefied on condensation. R-50 which is lower in boiling point still remains in the form of a gas. From the vapor-liquid separator 33, R-14 flows into the liquid-phase pipe 38, while R-50 as separated from R-14 flows into the vapor-phase pipe 43. R-14 passes through the dryer 38 and then through the unit 40 for a pressure reduction, flows into the connection between the second and third intermediate heat exchangers 42 and 44 and evaporates within the second exchanger 42. The exchanger 42 has a temperature of about −100° C. because the refrigerant of low temperature returning from the evaporation pipe 47 flows into the exchanger 42 and further because the evaporation of F-14 contributes to cooling. The third intermediate heat exchanger 44, into which the refrigerant of low temperature directly flows from the pipe 47, has an extremely low temperature of about −120° C., so that the refrigerant R-50 of the lowest boiling point is liquefied on condensation in the exchanger 44 after passing through the vapor-phase pipe 43 and heat exchange at the second exchanger 42. The condensate R-50 passes through the dryer 45 and then through the unit 46 for a pressure reduction and flows into and evaporates in the evaporation pipe 47. At this time, the temperature of the pipe 47 reaches −150° C. The refrigeration system R of the present invention eventually achieves this temperature. The storage chamber 76 of the refrigerator 75 (see FIG. 4) to be described later can be cooled to a cryogenic temperature of −140° C. by providing the evaporation pipe 47 in the chamber 76 for heat exchange. The refrigerant mixture (which is predominantly R-50) flowing out from the pipe 47 enters the third to first intermediate heat exchangers 44, 42 and 32 successively to join with R-14, R-13B1 and R-12. The resulting mixture flows out from the exchanger 32 into the accumulator 49, in which the unevaporated portion is separated off. The mixture then flows into the heat exchanger 24 and thereafter into the heat exchanger 22 for cooling and is aspirated by the compressor 10.

R-12 flowing from the first vapor-liquid separator 10 into the first intermediate heat exchanger 32 via the liquid-phase pipe 34 in the process described above remains liquid without evaporation, contributing nothing to cooling, since the refrigerant has already been cooled to a very low temperature. However, R-12 has dissolved therein the lubricant remaining unseparated by the oil separator 18 and the water remaining unremoved by the dryers to return these liquids to the compressor 10. If the lubricant of the compressor 10 circulates through the low-temperature refrigerant circuit 3 which has a cryogenic temperature, the lubricant will remain in various portions of the circuit to clog up the circuit. To avoid this objection, R-12 is used for returning the lubricant almost completely.

By repeatedly circulating the refrigerant mixtures as above, the refrigerant circuit 1 operates in a stead state to cause the evaporation pipe 47 to produce a cryogenic temperature of −150° C. For this purpose, the compressors 4 and 10 can be of a capacity of about 1.5 hp and do not require an especially great capacity, largely because the cascade condensers 25A and 25B effect satisfactory heat exchange and further because suitable refrigerant mixtures are used. The compressors therefore operate with a diminished noise and reduced power consumption. Furthermore, living body specimens (such as cells, blood and sperm) can be cooled to a temperature lower than the recrystallization point of ice for almost eternal preservation when stored in the refrigerator 75 which can be cooled to −150° C. The refrigerant mixture through the high-temperature refrigerant circuit 2 flows from the first evaporator 14A to the second evaporator 14B without dividedly flowing into these evaporators, so that even if the two evaporators 14A and 14B are brought out of temperature balance for one cause or another, no uneven refrigerant flow occurs. Consequently, both the first and second condensation pipes 23A and 23B of the low-temperature refrigerant circuit 3 can be cooled with good stability to achieve satisfactory condensation.

Figure 2:
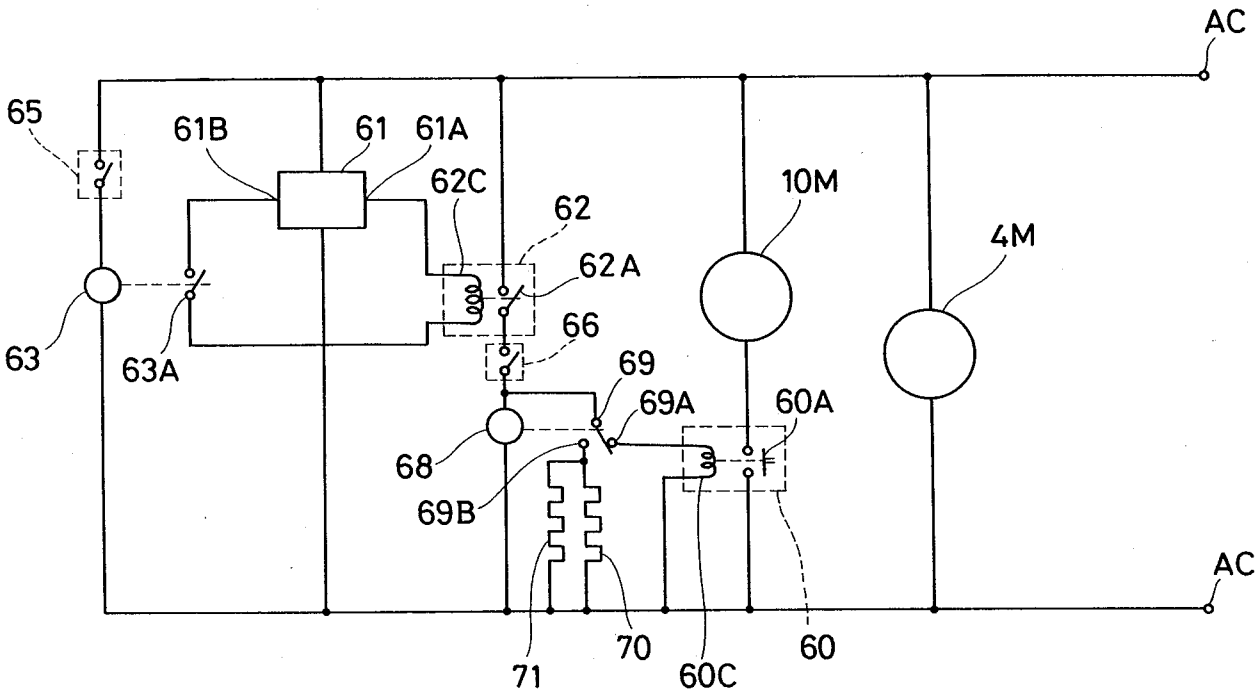

FIG. 2 schematically shows the electric circuit for controlling the refrigeration system R of the present invention. The compressor 4 of the high-temperature refrigerant circuit 2 is driven by a motor 4M which is connected between single-phase or three-phase a.c. power supply terminals AC and AC. The motor 4M is continuously driven while the power supply AC is on. The compressor 10 of the low-temperature refrigerant circuit 3 is driven by a motor 10M which is connected to the power supply AC via the contact 60A of an electromagnetic relay 60. The contact 60A is closed when the coil 60C of the relay 60 is energized to operate the motor 10M. Indicated at 61 is a temperature controller for the refrigerator storage chamber 76 to be described later. The controller 61, which is connected to the power supply AC, substantially detects the temperature of the storage chamber. Upper and lower limit temperatures are set for the controller with a suitable differential therebetween. At the upper limit temperature, a voltage is produced across output terminals 61A and 61B. The production of voltage discontinues at the lower limit temperature. The set temperature range is from −145° C. to −150° C. The coil 62C of a temperature control relay 62 and the contact 63A of a timer 63 are connected in series with the output terminals 61A and 61B. When energized, the coil 62C closes the contact 62A of the relay 62. The outlet pipe 10D of the compressor 10 in the low-temperature circuit 3 shown in FIG. 1 is provided with a high-pressure switch 65 before the inlet of the auxiliary condenser 17. The high-pressure switch 65 is connected to the power supply AC in series with the timer 63. When the pressure at the outlet side of the compressor 10 builds up, for example, to 26 kg/cm$^2$ to excessively load the compressor 10, the switch 65 opens. The switch closes when the pressure lowers to a fully safe level, e.g. 8 kg/cm$^2$ The timer 63 closes its contact 63A 3 to 5 minutes after the switch 65 closes and opens the contact 63A when the switch 65 opens. Indicated at 66 is a low-temperature start thermostat for detecting the temperature of the accumulator 15 of the circuit 2. While the accumulator 15 has nearly the same low temperature as the evaporators 14A and 14B since the refrigerant evaporating in these evaporators and the unevaporated refrigerant flow into the accumulator 15, the thermostat 66 closes its contact when the temperature of the accumulator 15 lowers, for example, to −35° C. and opens its contact when the temperature rises to −10 C. The thermostat 66 is connected at its opposite sides to the contact 62A of the temperature control relay 62 and a timer 68 in series therewith and further to the power supply AC. A change switch 69 for the timer 68 has a common terminal connected between the timer 68 and the thermostat 66, a terminal 69A connected to the power supply AC via the coil 60C of the relay 60, and another terminal 69B connected to the power supply AC via heaters 70 and 71 arranged in parallel and provided at the front and rear of the pressure reducing unit 46 shown in FIG. 1 in heat exchange relation therewith. The timer 68 usually holds the change switch 69 closed at the terminal 69A and is energized to count up hours. When the count reaches, for example, 12 hours, the timer closes the switch 69 alternatively at the terminal 69B, for example, for 15 minutes. The terminal 69A is thereafter closed again.

Figure 3:
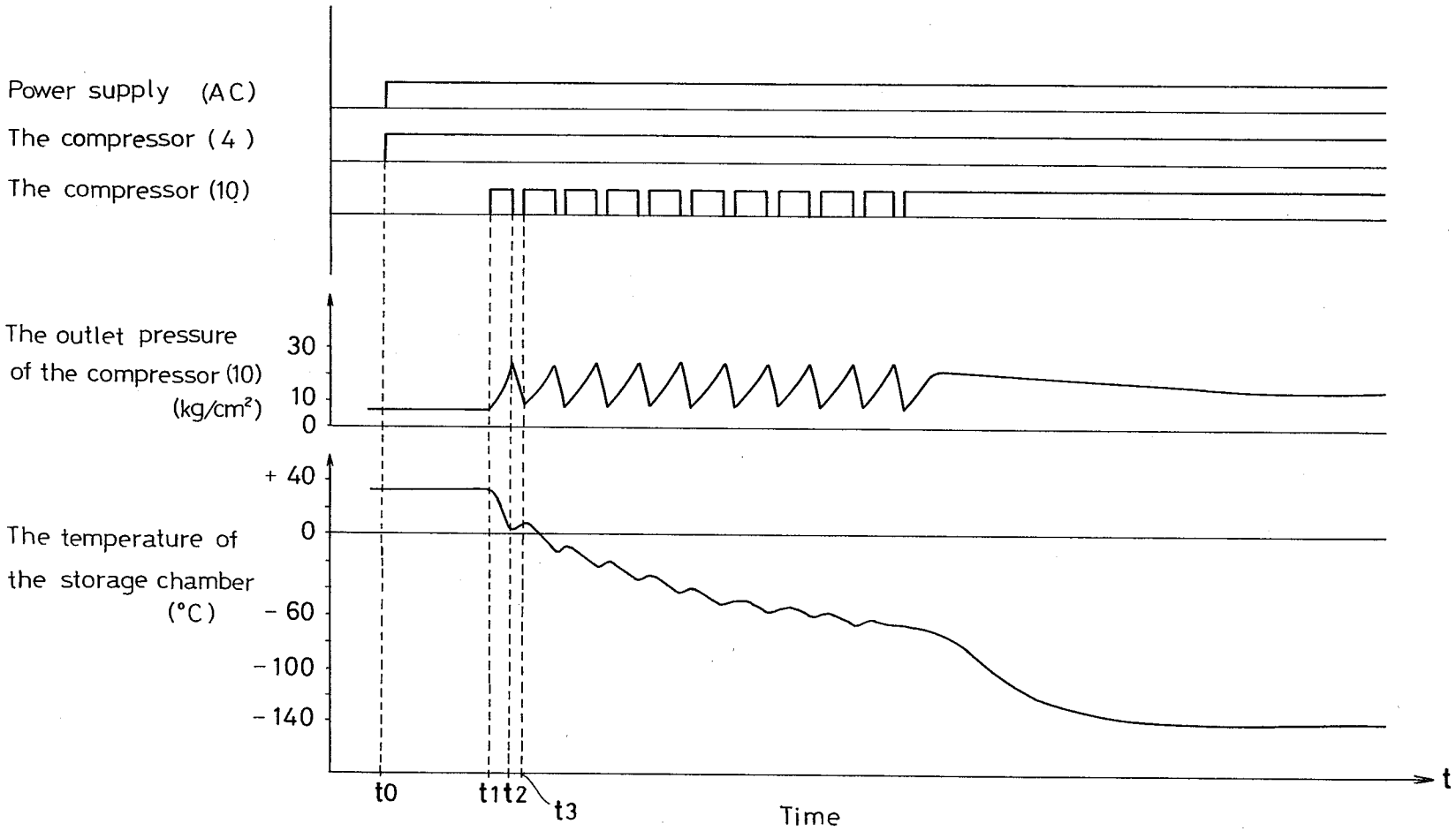

Next, the operation of the control circuit will be described with reference to the timing chart of FIG. 3. At time t0, the power supply AC is turned on to start the motor 4M and initiate the compressor 4 into operation, whereupon the refrigerant mixture starts circulating through the high-temperature refrigerant circuit 2. At this time, the accumulator 15 is nearly at room temperature, so that the contact of the low-temperature start thermostat 66 remains open. Consequently, irrespective of the presence of the temperature controller 61, the coil 60C of the relay 60 is unenergized with its contact 60A open, holding the motor 10M and therefore the compressor 10 of the low-temperature refrigerant circuit 3 out of operation. With the high-temperature refrigerant circuit 2 only in continued operation for cooling in this way, the refrigerant accumulates in the first and second evaporators 14A and 14B in a liquid state to result in a lowered temperature. With this, the temperature of the accumulator 15 also lowers and reaches −35° C. at time t1, whereupon the thermostat 66 closes its contact. Immediately before this closing, the compressor 10 is still out of operation, so that the high-pressure switch 65 is of course held closed. The contact 63A of the timer 63 is also closed since the power supply has been on for 3 to 5 minutes. Further because the internal temperature of the storage chamber 76 is of course higher than the temperature setting, the temperature controller 61 is delivering an output, closing the contact 62A of the temperature control relay 62. Accordingly, upon the thermostat 66 closing, the coil 60C of the relay 60 is energized to close its contact 60A, starting the motor 10M and causing the compressor 10 to discharge the refrigerant mixture for the start of circulation through the circuit 3. At this time, the components of the circuit 3 still have a high temperature, permitting the refrigerant mixture therein to remain in a gaseous state almost entirely and produce a high internal pressure. Since the compressor 10 forces out the refrigerant mixture in this state, the pressure of the outlet pipe 10D abruptly increases. If the circuit is allowed to stand in this state, the high pressure would cause damage to the components of the compressor 10. However, when the increased pressure reaches the permissible limit of 26 kg/cm$^2$ at time t2, the high-pressure switch 65 opens upon detecting the peak pressure value to open the contact 63A, whereby the contact 62A of the temperature control relay 62 is forced open. This deenergizes the coil 60C, opening the contact 60A and stopping the motor 10M to prevent the pressure from increasing at the outlet side of the compressor 10 and obviate damage to the compressor.

The pressure at the outlet pipe 10D decreases to 8 kg/cm$^2$ owing to the stopping of the compressor 10, but the presence of the chattering preventing timer 63 holds the contact 63A open for 3 to 5 minutes after the closing of the high-pressure switch 65, with the result that the motor 10M is held out of operation. In the meantime, a small amount of refrigerant cooled by the first or second condenser 23A or 23B is sent out from the first or second evaporator 14A or 14B for circulation through the low-temperature circuit 3, so that the circuit 3 is lower in temperature and pressure than when the motor was previously started. When the delay time set on the timer 63 is up at time t3, the contact 63A is closed, starting up the motor 10M again as already stated. When the pressure of the outlet pipe 10D reaches 26 kg/cm$^2$, the high-pressure switch 65 opens again to stop the motor 10M. In this way, the motor 10M is repeatedly brought into and out of operation to cause higher-boiling refrigerants to evaporate and gradually exhibit a cooling action, whereby the temperature of the system is gradually lowered first at the first intermediate heat exchanger 32. When the peak value of increased pressure of the outlet pipe 10D following the start-up of the motor 10M becomes lower than 26 kg/cm$^2$, the motor 10M remains in continuous operation.

With the continuous operation of the compressor 10, lower-boiling refrigerants are subjected to condensation, gradually exhibiting a cooling action and gradually lowering the temperature of the intermediate heat exchangers 32, 42, 44 and the evaporation pipe 47 to eventually achieve the contemplated temperature of −150° C. When the temperature of the storage chamber thereafter reaches the lower limit set by the temperature controller 61, the voltage across the output terminals 61A and 61B becomes no longer available, opening the contact 62A and further opening the contact 60A to stop the motor 10M and discontinue the cooling operation. Subsequently, the internal temperature of the storage chamber gradually rises and reaches the upper limit set by the controller 61, whereupon the contact 62A closes again. Further the motor 10M is initiated into operation with the closing of the contact 60A to resume cooling operation. The cooling cycle described is repeated to maintain the storage chamber at the set temperature, for example, of −140° C. on the average.

The timer 68 count up the hours during which the contact 62A and the thermostat 66 are closed, i.e. during which the motor 10M is in operation. When the count reaches 12 hours, the timer 68 closes the change switch 69 at the terminal 69B, holding the motor 10M out of operation and energizing the heaters 70 and 71 for heat generation. R-50 flowing out from the third intermediate heat exchanger 44 into the pressure reducer 46 has a very low temperature of −120° C. If the refrigerant contains a very small amount of water (which is likely to become incorporated into the refrigerant, for example, during replenishment thereof), icing occurs within the piping. Since the pressure reducer 46 usually comprises a very thin tube, growth of ice within the unit 46 clogs up the tube to block the flow of refrigerant. According to the present invention, the pressure reducer 46 is periodically heated by the heaters 70 and 71 to prevent growth of ice crystals by melting and obviate the above trouble. The heaters 70 and 71 are energized for 15 minutes, and the switch 69 is closed at the terminal 69A again to start up the motor 10M and initiate the low-temperature circuit 3 into cooling operation in the same manner as above.

Figure 4:
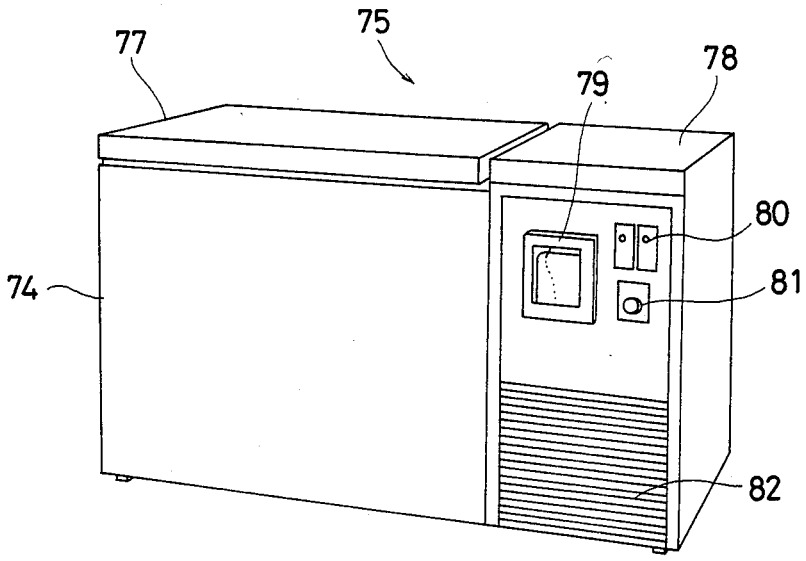
Figure 5:
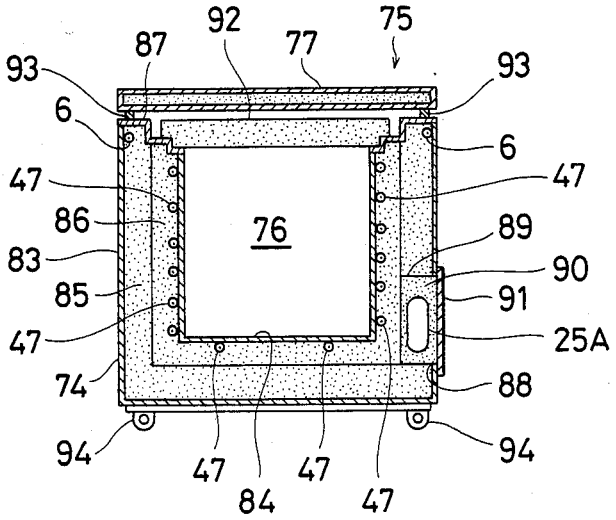
Figure 6:
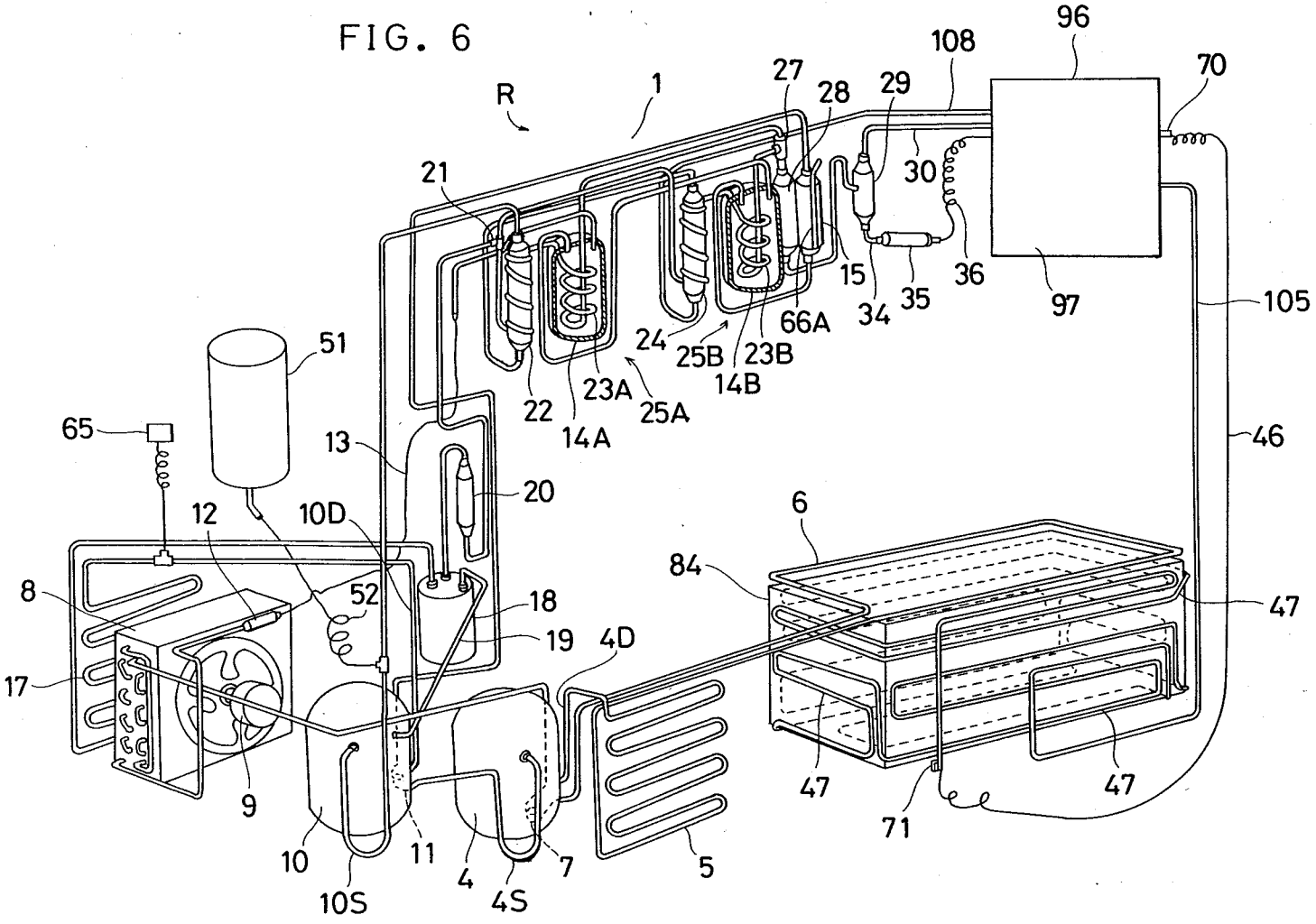

FIG. 4 is a perspective view showing the front side of the refrigerator 75 embodying the invention, FIG. 5 is a fragmentary view in section of the same, and FIG. 6 is a diagram specifically illustrating the construction of the refrigerant circuit 1 of the refrigeration system R. The refrigerator 75, which is to be installed in a physicochemical laboratory or the like, comprises a main body 74 formed in its interior with the aforementioned storage chamber 76 having a top opening. The top opening is openably closed with a heat insulating door 77 which is pivoted to the rear edge of the main body. The main body 74 has at its one side a machine chamber 78 accommodating the temperature controller 61, compressors 4, 10, etc. The machine chamber 78 is provided on its front side with a self-recording temperature recorder 79 for detecting the internal temperature of the storage chamber 76 and recording the temperature variations with time on paper, a known alarm 80 for giving an alarm upon detecting an abnormal high temperature of the storage chamber 76, and a knob 81 for changing the settings for the temperature controller 61. Indicated at 82 is a louver.

FIG. 5 is a side elevation showing the main body 74 in section. Indicated at 83 is a steel outer case having an upper opening, and at 84 an aluminum inner case similarly having an upper opening. The inner case 84 is housed in the outer case 83. Provided in the space between the two cases 83 and 84 is a double heat insulating layer comprising an outer heat insulator 85 and an inner heat insulator 86 which are independent of each other and each in the form of a box having an upper opening. The opening edges of the two cases 83 and 84 are connected together by a breaker 87. The evaporation pipe 47 is thermally conductively provided around the inner case 84 and embedded in the inner heat insulator 86. The defrosting pipe 6 is thermally conductively provided along the opening edge of the outer case 83 inside thereof. The inner heat insulator 86 is merely placed in the outer heat insulator 85 and is completely separate therefrom, so that even if the inner insulator 86 shrinks owing to the cooling effect of the evaporation pipe 47, the outer insulator 85 remains free of cracking without being influenced thereby in any way, thus retaining a satisfactory heat insulating property. The outer case 83 has an opening 88 in its rear side, while the outer insulator 85 is formed with a cutout 89 corresponding to the opening 88. The cascade condensers 25A, 25B, etc. covered with a molding of heat insulating material 90 as will be described later are placed into the cutout 89 through the opening 88, which is closed with a cover plate 91. Indicated at 92 is an inner closure of expanded styrol, and at 93 a gasket provided along the periphery of the door 77 inside thereof. The main body 74 has castors 94.

The refrigerant circuit 1 of the refrigeration system R will be described more specifically with reference to FIG. 6. Throughout FIGS. 1 and 6, like parts are designated by like reference numerals. The auxiliary condenser 17 of the low-temperature refrigerant circuit 3 is disposed upstream from the condenser 8 of the high-temperature refrigerant circuit 2 with respect to the flow of air drawn into the system by the fan 9. The two condensers are cooled at the same time by the air drawn in. The first (second) evaporator 14A (14B) is in the form of a hollow tank having the first (second) condensation pipe 23A (23B) in the form of a helical winding inserted therein from above. A tube 66A is directly fixed to the accumulator 15 for fixing the low-temperature start thermostat 66. An intermediate heat exchanger unit 96 comprises the intermediate heat exchangers 32, 42, 44, etc. to be described later and molded into a box using a heat insulating material 97. The evaporation pipe 47 is fixed in a zigzag pattern to the outer surface of the inner case 84 with an aluminum tape, adhesive or the like. To make the interior of the storage chamber 76 uniform in temperature to the greatest possible extent, the pipe 47 is provided around the case 84 so that the refrigerant therein first flows around the inner case 84 from the upper portion thereof downward then flows over the bottom side thereof.

Figure 7:
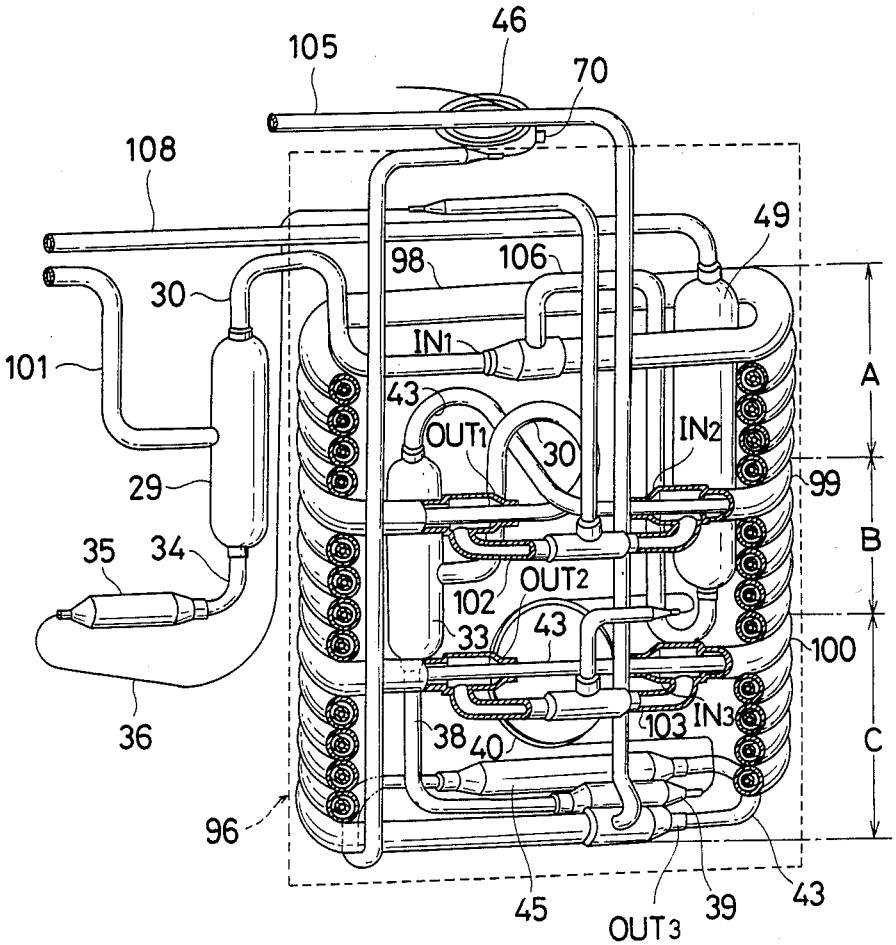

FIG. 7 shows the construction of the intermediate heat exchanger unit 96. The unit 96, which is illustrated as surrounded by a dot line, includes the first to third intermediate heat exchangers 32, 42, 44, second vapor-liquid separator 33, dryers 39, 45, pressure reducer 40 and accumulator 49. The heat exchangers 32, 42 and 44 comprise outer tubes 98, 99 and 100 having a relatively large diameter, helically wound several turns and shaped to a flat form, the windings being joined together one above another. The vapor-phase pipes 30 and 43 extend through the tubes with a space formed therebetween. Thus, the heat exchangers have a helical double tubular structure. In FIG. 7, the first intermediate heat exchanger 32 is indicated at A, the second exchanger 42 at B and the third exchanger 44 at C. The second vapor-liquid separator 33, dryers 39, 45, pressure reducer 40 and accumulator 49 are accommodated inside the helical windings to diminish the dead space and make the unit 96 compact.

The construction of the unit 96 will be described in greater detail. Indicated at 101 is a pipe connecting the dryer 28 to the first vapor-liquid separator 29. The vapor-phase pipe 30 extending upward from the separator 29 enters the outer tube 98 at a sealed inlet IN1, helically extends through the tube, then comes out of an outlet OUT1 and enters the second vapor-liquid separator 33. The gaseous refrigerants flowing down the vapor-phase pipe 30 are condensed by the low-temperature refrigerants flowing upward through the space between the pipe 30 and the outer tube 98. The vapor-phase pipe 43 extending from the second separator 33 enters the outer tube 99 at an inlet IN2. The liquid refrigerants separated off by the first separator 29 are passed through the pressure reducer 36 for a pressure reduction, then led into an intermediate portion of a communication pipe 102 connecting the outlet OUT1 of the outer tube 98 to the inlet IN2 of the tube 99 and evaporate inside the tube 98, coacting with the refrigerant returning from the evaporation pipe 47 to condense the gaseous refrigerants within the pipe 30. The vapor-phase pipe 43 through the tube 99 emerges therefrom at an outlet OUT2, enters the outer tube 100 at an inlet IN3, helically extends through the tube 100 and comes out from an outlet OUT3. The outer tubes are sealed off at the outlets and inlets. The liquid refrigerant separated off by the second separator 33 flows through the dryer 39 provided in heat exchange relation with the outer tube 100, is passed through the reducer 40 for a pressure reduction, then led into an intermediate portion of a communication pipe 103 connecting the outlet OUT2 of the outer tube 99 to the inlet IN3 of the tube 100 and evaporate within the outer tube 99, coating with the refrigerant returning from the evaporation pipe 47 to condense the gaseous refrigerant within the vapor-phase pipe 43. The refrigerant R50 flowing down the pipe 43 is almost entirely condensed to a liquid while passing through the outer tube 100 and flows into the pressure reducer 46 via the dryer 45 provided in heat exchange relation with the outer tube 100. A pipe 105 connected between the outlet end of the evaporation pipe 47 and the outlet OUT3 of the outer tube 100 is in communication with the space around the vapor-phase pipe 43 within the tube 100. At the inlet IN1 of the outer tube 98, the space around the vapor-phase pipe 30 is held in communication with the accumulator 49 by a pipe 106. Thus, the refrigerant returning from the evaporation pipe 47 flows through the pipe 105 into the space between the outer tube 100 and the vapor-phase pipe 43, ascends the space while condensing the refrigerant flowing down the vapor phase pipe 43 and joins at the communication pipe 103 with the refrigerant from the pressure reducer 40. The refrigerant mixture flows into the space between the outer tube 99 and the vapor-phase pipe 43, ascends the space while condensing the refrigerant within the pipe 43 and joins at the communication pipe 102 with the refrigerants from the pressure reducer 36. The resulting mixture flows upward through the space between the outer tube 98 and the vapor-phase pipe 30 while condensing the refrigerants within the pipe 30, then reaches the accumulator 49 via the pipe 106 and thereafter flows into the aspiration-side heat exchanger 24 via a pipe 108. Thus, the descending refrigerant flow through the vapor phase pipe 30 or 43 is in countercurrent relation with the refrigerant flow ascending the spaces in the outer tubes 100, 99 and 98 around the pipe 30 or 34 from the evaporation pipe 47.

Figure 8:
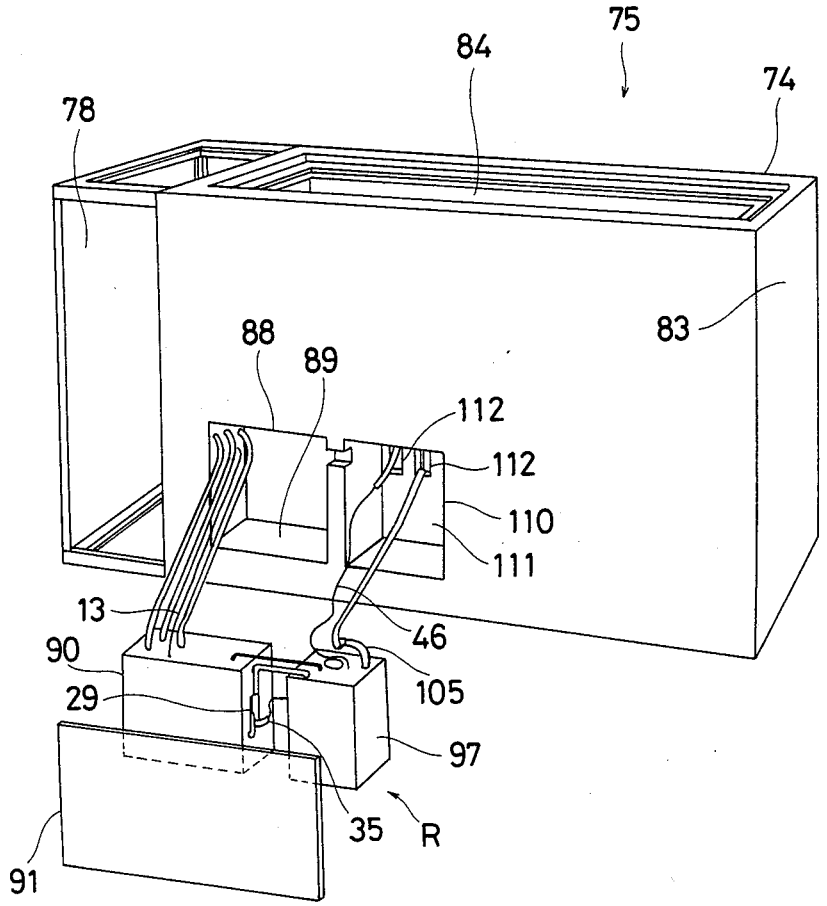

The procedure for installing the refrigeration system R into the main body 74 will be described with reference to FIG. 8 which is a perspective view showing the rear side of the refrigerator 75. The outer case 83 is formed in its rear side with an opening 110 at one side of the opening 88. The outer heat insulator 85 is formed with a cutout 111 corresponding to the opening 110. By molding, the heat insulator 90 has enclosed therein the cascade condensers 25A, 25B, aspiration-side heat exchangers 22, 24, accumulator 15 and dryer 28. The insulators 90 and 97 are molded by placing the parts into a resin bag, placing the bag into a box-shaped mold, filling a urethane heat insulating material into the bag and expanding the material. The pressure reducer 46 and the pipe 105 which are made to extend outward from the insulator 97 are connected by welding to the evaporation pipe 47 led out through outlets 112 and 112 in the inner portion of the cutout 111. The pipes for the pressure reducer 13, etc. made to extend out through the insulator 90 are connected by welding to the pipes led out through the wall adjacent the machine chamber 78 and defining the cutout 89. With the first vapor-liquid separator 29 and the dryer 35 positioned outside the insulator 90, the insulators 90 and 97 as interconnected by piping are fitted into the cutouts 89 and 111, glass wool or the like is filled into the remaining clearances, and the cutouts 89 and 111 are closed with the cover plate 91, whereby the system is completely installed in place. The compressors 4, 10, condenser 8, fan 9, expansion tank 51, etc. are installed in the machine chamber 78 before the above procedure. Thus, the refrigerator 75 is completed.

Figure 9:
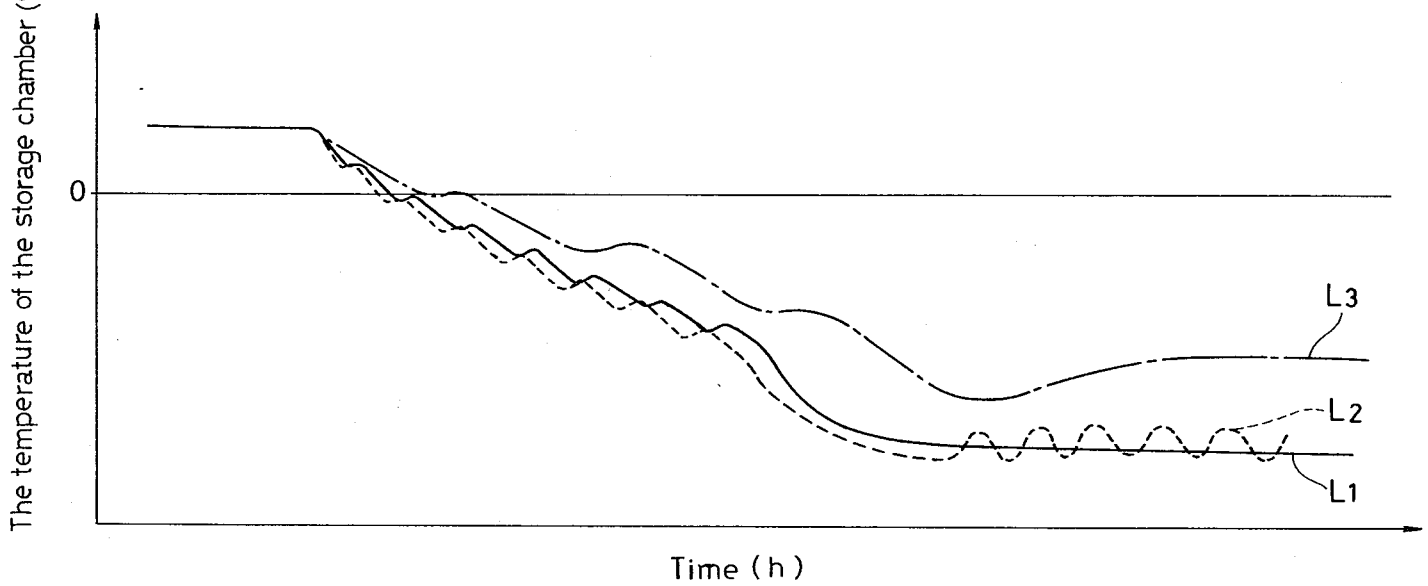

While the ideal operation of the refrigeration system R of the present invention has already been described, the final stage of the system i.e. the region including the third intermediate heat exchanger 44 through the evaporation pipe 47 is cooled to a very low temperature of −120° to −150° C. as described above, so that even if the system is strictly heat-insulated as already stated, the liquid refrigerant passing through the third exchanger 44 tends to evaporate within the pressure reducer 46 owing to the transmission of heat from the environment. The uncondensed refrigerant from the second vapor-liquid separator 33, although containing a small amount of R-14, is almost entirely R-50. FIG. 9 shows the relation between the pressure of the refrigerant R-50 and the evaporation temperature thereof. The inside diameter of the tube of the pressure reducer 46 is very small (usually up to 1 mm) as already stated, so that when the refrigerant R-50 evaporates within the reducer 46, the interior of the reducer 46 is immediately filled up with the vapor of the refrigerant, consequently producing excessively great resistance to the flow of refrigerant and blocking the flow of liquid refrigerant. Consequently, the evaporation pipe 47 rises in temperature, failing to fully cool the storage chamber 76.

However, prevention of passage of the liquid refrigerant through the pressure reducer 46 produces an increased pressure before the inlet of the reducer 46, consequently raising the evaporation temperature of the refrigerant R-50 as seen in FIG. 9. The refrigerant therefore ceases evaporation within the reducer 46, with the result that the supply of liquid refrigerant to the evaporation pipe 47 is resumed to effect normal cooling. Nevertheless, when the temperature consequently lowers, evaporation occurs again within the reducer 46 as stated above, and the process is repeated. In such a situation, the storage chamber 76 will not be fully cooled, while the markedly varying loads exerted on the compressor 10 shorten the life of the compressor and produce great noises. According to the present invention, therefore, the dryer 45 is provided in heat exchange relation with the third intermediate heat exchanger 44 to cool the refrigerant R-50 again after passage through the exchanger 44 and to inhibit the rise of temperature due to the transmission of heat from the environment. This serves to prevent evaporation of the refrigerant within the pressure reducer 46, obviating insufficient cooling.

Figure 10:
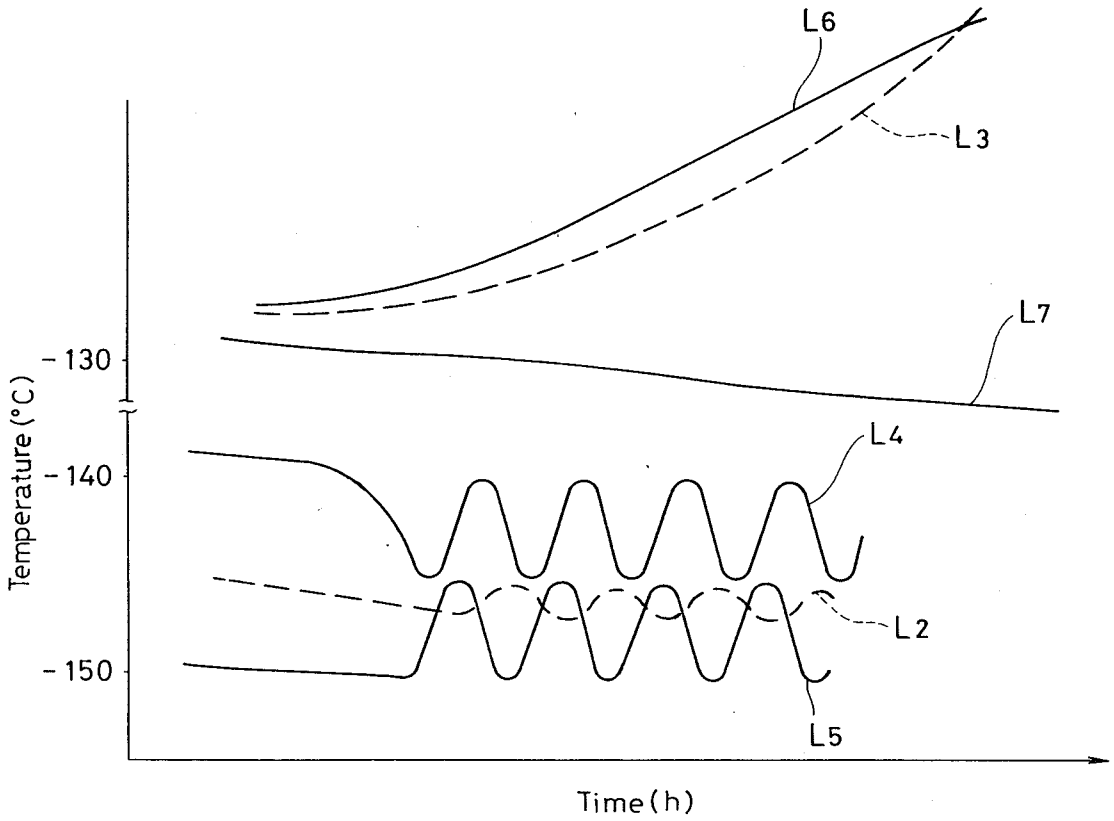
FIG. 10 is a diagram showing the temperature of the storage chamber approximately at the temperature achieved by a low-temperature refrigerant circuit when the amount of refrigerant charged in the circuit is excessively large or excessively small.

The abnormal situation described is encountered also when the amount of refrigerant charged in the low temperature refrigerant circuit 3 is not proper. FIG. 9 shows variations in the internal temperature of the storage chamber 76 with the lapse of time after the power supply for the refrigeration system R is turned on. Curve L1 represents a case wherein a proper amount of refrigerant is charged in, curve L2 represents a case wherein an excessive amount of refrigerant is charged in, and curve L3 represents a case wherein the amount of refrigerant is insufficient. Shown in FIG. 10 are the internal temperature L2 of the storage chamber 76 when the amount of refrigerant charged in is excessive approximately at the temperature achieved, the corresponding temperature L3 when the amount is insufficient, the temperature L4 of the refrigerant flowing into the pressure reducer 46, i.e. the temperature thereof at the inlet P1 of the reducer 46 shown in FIG. 1, when the amount of refrigerant is excessive, the temperature L5 of the refrigerant flowing out from the reducer 46, i.e. the temperature thereof at the inlet P2 of the evaporation pipe 47 shown in FIG. 1, when the amount of refrigerant is similarly excessive, the temperature L6 of the inlet P1 of the reducer 46 when the amount of refrigerant is insufficient, and the temperature L7 of the inlet P2 of the pipe 47 when the amount is insufficient.

When the amount of refrigerant charged in is excessive, the rate at which the temperature of the storage chamber 76 lowers after the start of cooling operation is greater than when the amount if normal. However, with an excess of liquid refrigerant supplied to the evaporation pipe 47, a large amount of liquid refrigerant failing to evaporate within the pipe 47 flows into and evaporates in the third intermediate heat exchanger 44, after the interior of the storage chamber 76 reaches the contemplated temperature to be achieved, with the result that the heat exchanger 44 is cooled to the same temperature as the evaporation pipe 47. The temperature at the inlet P1 of the pressure reducer 46 consequently lowers to a level which is greatly different from the ambient temperature. This permits penetration of an increased amount of heat into the reducer 46 from the environment to promote evaporation of the liquid refrigerant. Thus, the liquid refrigerant starts evaporation within the reducer 46 to increase the internal pressure of the reducer 46, hamper the flow of liquid refrigerant and decrease the supply of liquid refrigerant to the evaporation pipe 47. The internal temperature of the storage chamber 76 therefore rises with a rise in the temperature of the inlet P2. When the flow of liquid refrigerant through the pressure reducer 46 is impeded, the pressure of the liquid refrigerant increases as already stated, the evaporation temperature accordingly rises and the liquid refrigerant ceases to evaporate, subsequently permitting the passage of refrigerant through the reducer 46 again for normal cooling operation. However, the same situation as above repeatedly occurs when the cooling operation thereafter results in the presence of an excess of liquid refrigerant within the pipe 47. Thus the temperatures fluctuate in pulsation unstably as represented by curves L2, L4 and L5 in FIG. 10. The internal temperature of the storage chamber 76 varies with a slight delay. In such a situation, the internal temperature of the storage chamber 76 periodically exceeds the normal level L1 as seen in FIG. 9, hence insufficient cooling. Moreover, the compressor 10 will then produce greater vibration and noise and wear abnormally.

In the situation described above, the temperature of the refrigerant flowing into the pressure reducer 46 approaches the temperature of the refrigerant flowing out therefrom. That is, the temperature at the inlet P1 of the reducer 46 lowers to a level close to the temperature at the inlet P2 of the evaporation pipe 47. Experiments have revealed that approximately at the temperature to be achieved, the difference between these temperatures is not greater than 10° C. According to the present invention, therefore, the refrigerant is charged in such an amount that the temperature difference between the points P1 and P2 is greater than 10° C. This precludes the presence of an excess of refrigerant to obviate the pulsating variations in temperature and to assure a stable cooling operation. In addition, the dryer 45 is provided for heat exchange with the third intermediate heat exchanger 44 to lessen the influence of penetration of ambient heat and to achieve more stable temperatures.

Next, when the amount of refrigerant is insufficient, a lower cooling rate naturally results as represented by curve L3 in FIG. 9. Further although in a small amount, the refrigerant circulates through the low-temperature refrigerant circuit 3, so that a small quantity of liquid refrigerant flows into the evaporation pipe 47 from the pressure reducer 46 and immediately evaporates in the pipe 47, consequently lowering the temperature at the inlet P2 of the pipe 47 as represented by curve L7 in FIG. 10. However, since the amount of liquid refrigerant is small, the evaporation ceases immediately, with the result that the vapor of refrigerant only flows from the pipe 47 into the third intermediate heat exchanger 44. Accordingly, the interior of the storage chamber 76 becomes insufficiently cooled, the temperature rises and levels off at a high value as represented by curve L3, and the temperature of the third heat exchanger 44 also rises. As represented by curve L6, this raises the temperature at the inlet P1 of the pressure reducer 46 through which the refrigerant passes after heat exchange with the exchanger 44, greatly increasing the temperature difference between the points P1 and P2.

With the refrigeration system R of the present invention, the difference of 100° C. between the temperature (−50° C.) of the cascade condensers 25A, 25B and the temperature (−1502 C.) of the evaporation pipe 47 is produced stepwise by creating temperature differences across the pressure reducers 36, 40 an 46. The temperature difference to be provided by each of the pressure reducers 36, 40 and 46 is 33° C. when the overall difference is equally divided. (Usually the temperature difference is so set as to decrease with a decrease in the temperature so as to diminish the load to the greatest possible extent.) The circuit is in an abnormal state if the temperature difference between the inlet P1 of the reducer 46 and the inlet P2 of the evaporation pipe 47 is greater than the difference of 33° C. around the temperature to be achieved. The abnormality is attributable to the insufficiency of the refrigerant charged. With the present invention, therefore, he refrigerant is charged in such an amount that the temperature difference between the points P1 and P2 will be smaller than 33° C. to obviate insufficient refrigeration due to insufficient refrigerant.

To sum up, the proper amount of refrigerant to be charged into the circuit is such that the difference between the temperature of the refrigerant flowing into the pressure reducer 46 and that of the refrigerant flowing out therefrom, as determined from the temperature at the inlet P1 of the reducer 46 and the temperature at the inlet P2 of the pipe 47, will be, in the neighborhood of the temperature to be achieved, in the range of greater than 10° C. to smaller than the value obtained by dividing the temperature difference between the cascade condensers 25A. 25B and the evaporation pipe 47 by the number of pressure reducers 36, 40, 46, i.e., 33° C.

The refrigeration system R is influenced also by the ambient temperature. When the refrigerant is charged in such an amount as to exhibit full performance at a high ambient temperature, the following objection will arise. If the ambient temperature lowers, the temperature of the cascade condensers 25A, 25B and the intermediate heat exchangers 32, 42, 44 also lowers, so that in addition to the refrigerant to be condensed by the intermediate heat exchangers, the refrigerant portion to be condensed by the subsequent heat exchanger is also condensed partly and return to the compressor 10. This decreases the amount of refrigerant R-50 eventually flowing into the evaporation pipe 47 to result in insufficient refrigeration. If an increased amount of refrigerant is used to eliminate the objection, the aforementioned pulsating temperature variation will occur when the ambient temperature rises.

These objections have been overcome by the present invention using the refrigerant in such an amount that the temperature difference between the points P1 and P2 will be greater than 10° C. but smaller than 33° C. This assures stable cooling performance at high to low ambient temperatures.

Figure 11:
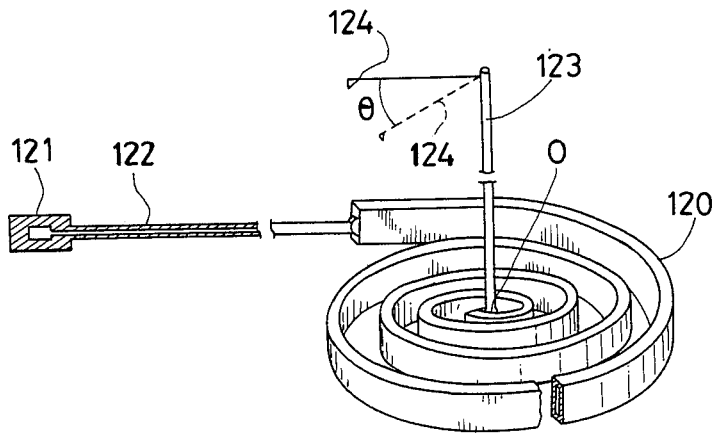
FIGS. 11 and 12 show a self-recording temperature recorder embodying the invention.

The self-recording temperature recorder 79 is adapted to record the internal temperature of the storage chamber 76 and is an important component of refrigerators of the type described. The recorder 79 generally comprises a Bourdon tube 120 in the form of a known Archimedes' screw as shown in FIG. 11 and unillustrated record paper or the like which is automatically moved with the lapse of time. With reference to FIG. 11, a temperature sensor portion 121 is so disposed as to detect the internal temperature of the storage chamber 76. The sensor portion 121 is connected to the Bourdon tube 120 in communication therewith by a thin tube 122. An upright drive shaft 123 is fixed to the Bourdon tube 120 for example at the center 0 of its helix. A recording pointer 124 is attached to the upper end of the shaft 123. The Bourdon tube 120 is hollow and has enclosed therein a temperature sensitive liquid substance such as ethyl alcohol or n-propyl alcohol. The Bourdon tube 120 deforms owing to the variation in the internal pressure due to a variation in the temperature around the sensor portion 121 to rotate the drive shaft 123 about its axis. It is known that the angle of rotation $\theta$ is in proportion to the variation in the internal pressure of the Bourdon tube 120. The internal temperature of the storage chamber 76 is recorded as converted to the position of the pointer 124.

Figure 12:
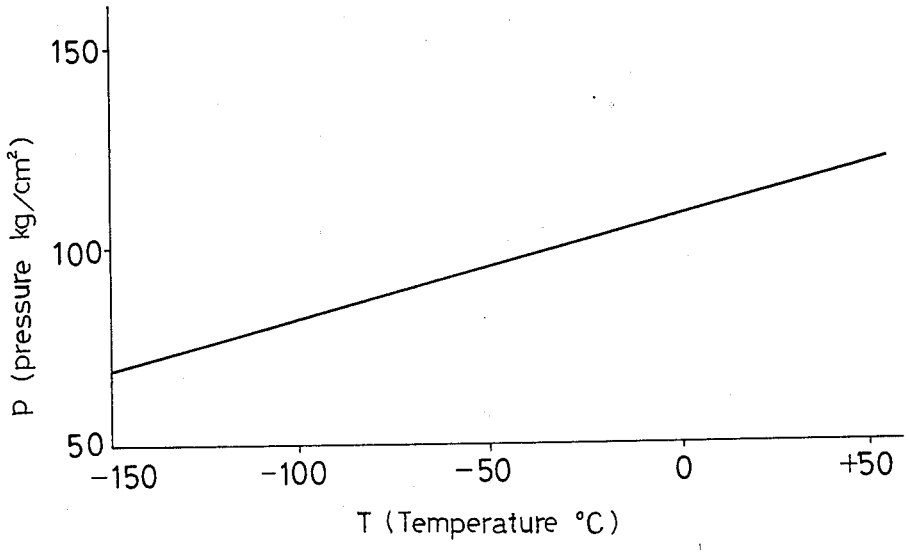

The common temperature sensitive substance such as ethyl alcohol or n-propyl alcohol is used, for example, at a temperature of about −80° C., but freezes at a cryogenic temperature of −150° C. achieved by the present invention and is not usable for the temperature recorder. We have conducted research and succeeded in recording cryogenic temperatures of about −150° C. using 2-methylpentane (isohexane) as a temperature sensitive substance. FIG. 12 shows the relation between the temperature T around the sensor portion 121 and the internal pressure P of the Bourdon tube 120 having 2-methylpentane enclosed therein. The diagram reveals that the pressure P is approximately in proportion to the temperature T over the temperature range of from −150° C. to +50° C. The angle of rotation $\theta$ of the pointer 124 is in proportion to the pressure P as already stated and is therefore approximately in proportion to the temperature T. Thus, the internal temperature of the storage chamber 76 can be recorded over the range of from −150° C. to +50° C.

As described above, the refrigeration system R of the invention achieves a very low temperature with use of electric compressors of usual capacity without necessitating compressors of greater output. With the arrangement of the invention, the evaporator of the first (closed) refrigerant circuit can be combined with the high-pressure line (pipe) of the second (closed) refrigerant circuit in heat exchange relation therewith to provide a plurality of divided cascade condensers. This renders the refrigeration system installable with greater freedom and smaller in its entirety. Further the evaporator portions of the first circuit are connected in series with respect to the refrigerant flow, while the high-pressure line [pipe) of the second circuit comprises a plurality of parallel line [pipe) portions. Even if the evaporator portions are brought out of temperature balance, this arrangement does not permit an uneven flow of refrigerants since the refrigerants do not flow through the evaporator portions dividedly, enabling the evaporator portions to exhibit stable condensation performance and further subjecting the refrigerant mixture through the high-pressure line (pipe) to satisfactory heat exchange. Consequently, cryogenic temperatures can be achieved with good stability.

The plurality of divided cascade condensers are realized by dividing the evaporator of the first (closed) refrigerant circuit into a plurality of evaporator portions and arranging the high-pressure line (pipe) of the second (closed) refrigerant circuit in heat exchange relation therewith. If the evaporator portions of the first circuit are connected in parallel with respect to the refrigerant flow and when the temperature of one of the evaporator portions builds up, the vapor pressure in that portion increases to impede the inflow of refrigerant, with the result that the temperature of the evaporator portion further rises. In this way, when the temperature balance is once disturbed in the parallel arrangement of the evaporator portions, the unbalance becomes amplified to greater unbalance to entail the problem that the evaporator portions differ in the ability to condense the refrigerant mixture flowing through the high-pressure line (pipe) of the second circuit. Further if the high-pressure line (pipe) portions of the second circuit, as arranged in series with respect to the refrigerant flow, are combined with the evaporator portions, the arrangement produces a temperature difference between the evaporator portions (raises the temperature of the upstream evaporator portion) to result in the abovementioned unbalance, further failing to achieve a higher heat exchange efficiency than the arrangement wherein the evaporator of the first circuit is not divided.

What is claimed is:

1. A refrigeration system comprising:

first and second refrigerant circuits each having a compressor, a condense and an evaporator, the outlet of the compressor being connected to the inlet of the condenser by a line, the outlet of the condenser being connected to the inlet of the evaporator by another line, the outlet of the evaporator being connected to the inlet of the compressor by another line, each of the refrigerant circuits being charged with an organic refrigerant, the evaporator of the first refrigerant circuit being divided into a plurality of evaporator portions connected together in series with respect to the flow of the refrigerant, the refrigerant of the first refrigerant circuit flowing successively into the evaporator portions, the condenser of the second refrigerant circuit being divided into condenser portions equal in number to the number of the evaporator portions of the first refrigerant circuit, the condenser portions being connected together in parallel with respect to the flow of the refrigerant, the refrigerant of the second refrigerant circuit being divided into volumes equal in number to the condenser portions to flow into each of them, the condenser portions of the second refrigerant circuit being paired with the evaporator portions of the first refrigerant circuit to provide heat exchangers, the refrigerant of the second refrigerant circuit being a mixture of refrigerants different in kind and in boiling point, whereby the evaporator of the second refrigerant circuit is cooled to cool the storage chamber to a cryogenic temperature. mixture of refrigerants different in kind and in boiling point, whereby the evaporator of the second refrigerant circuit is cooled to a cryogenic temperature.

2. A refrigeration system as defined in claim 1 wherein the refrigerant charged in the first refrigerant circuit is an organic refrigerant containing $CCl_2F_2$, and the refrigerant charged in the second refrigerant circuit comprises at least two organic refrigerants including $CH_4$ and having different boiling points.

3. A refrigeration system as defined in claim 1 wherein the evaporator portions of the first refrigerant circuit and the condenser portions of the second refrigerant circuit constitute two to four heat exchangers approximately equal in capacity.

4. A refrigeration system as defined in claim 2 wherein the evaporator portions of the first refrigerant circuit and the condenser portions of the second refrigerant circuit constitute two heat exchangers approximately equal in capacity.

5. A refrigeration system as defined in claim 1 wherein the line connecting the outlet of the evaporator of the second refrigerant circuit to the inlet of its compressor has a plurality of intermediate heat exchangers connected together in series, within the line connecting the outlet of the condenser of the second refrigerant circuit to the inlet of the evaporator thereof said plurality of said first means is situated including pressure reducers and vapor-liquid separators smaller in number to the number of the pressure reducers, and comprises a first line portion for introducing the refrigerant flowing through the condenser of the second refrigerant circuit into one of the vapor-liquid separators and admitting the condensed portion of the refrigerant into one of the intermediate heat exchangers through one of the pressure reducers, a number of line portions for bringing the uncondensed portion of the refrigerant form said one vapor-liquid separator into heat exchange with said one intermediate heat exchanger, subsequently introducing the second-mentioned portion of the refrigerant into another one of the vapor-liquid separators and admitting the resulting condensed portion of the refrigerant into another one of the intermediate heat exchangers through another one of the pressure reducers, and said second means is a line portion in the final stage for admitting the portion of the refrigerant having the lowest boiling point and passing through the line portions into the evaporator of the second refrigerant circuit through the pressure reducer in the final stage.

6. A refrigeration system as defined in claim 5 wherein the temperature difference between the refrigerant flowing into the pressure reducer in the final stage and the refrigerant flowing out of the pressure reducer in the final stage is smaller than the value obtained by dividing the temperature difference between the condenser of the second refrigerant circuit and the evaporator thereof by the number of the pressure reducers and larger than 10° C.

7. A refrigeration system as defined in claim 5 wherein the refrigerant charged in the first refrigerant circuit is an organic refrigerant containing $CCl_2F_2$, and the refrigerant charged in the second refrigerant circuit comprises at least two organic refrigerants including $CH_4$ and having different boiling points.

8. A refrigeration system as defined in claim 5 wherein the line connecting the outlet of the condenser of the second refrigerant circuit to the inlet of the evaporator thereof has two to five pressure reducers, and the line connecting the outlet of the evaporator of the second refrigerant circuit to the inlet of its compressor has intermediate heat exchangers equal to or greater than the pressure reducers in number.

9. A refrigeration system as defined in claim 8 wherein the line connecting the outlet of the condenser of the second refrigerant circuit to the inlet of the evaporator thereof has three pressure reducers, and the line connecting the outlet of the evaporator of the second refrigerant circuit to the inlet of the compressor thereof has three intermediate heat exchangers.

10. A refrigeration system as defined in claim 5 wherein the evaporator portions of the first refrigerant circuit and the condenser portions of the second refrigerant circuit constitute two to four heat exchangers approximately equal in capacity.

11. A refrigeration system as defined in claim 10 wherein the evaporator portions of the first refrigerant circuit and the condenser portions of the second refrigerant circuit constitute two heat exchangers approximately equal in capacity.

* * * * *